US007640749B2

(12) United States Patent
Yousoufian

(10) Patent No.: US 7,640,749 B2
(45) Date of Patent: Jan. 5, 2010

(54) MOISTURE SEPARATOR AND REHEATER

(76) Inventor: Hrant H. Yousoufian, 1 Argyle Rd., Montclair, NJ (US) 07043-2411

( * ) Notice: Subject to any disclaimer, the term of this patent is extended or adjusted under 35 U.S.C. 154(b) by 607 days.

(21) Appl. No.: 11/355,224

(22) Filed: Feb. 16, 2006

(65) Prior Publication Data

US 2007/0186874 A1 Aug. 16, 2007

(51) Int. Cl.
*F01K 7/34* (2006.01)

(52) U.S. Cl. ..... 60/653; 122/32; 122/483

(58) Field of Classification Search ..... 60/653, 60/670; 122/483, 32
See application file for complete search history.

(56) References Cited

U.S. PATENT DOCUMENTS 1,722,788 A * 7/1929 Cook ..... 165/9
2,298,242 A * 10/1942 Wegmann ..... 55/345
4,015,562 A * 4/1977 Yousoufian ..... 122/483
4,796,695 A * 1/1989 Cannon ..... 165/159

* cited by examiner

*Primary Examiner*—Hoang M Nguyen
(74) *Attorney, Agent, or Firm*—Gerald E. Hespos; Anthony J. Casella

(57) ABSTRACT

Contrasted to the prior art, the present invention presents a path for the cycle steam having the fewest possible changes in direction to minimize parasite pressure losses. This invention accommodates proportioning the flow areas of the moisture separator—reheater(s) assembly to optimize performance of extracting the maximum energy from the cycle steam and in view of the economics of first cost and operating cost. The reheater tubes are straight, not U-tubed, and sloped towards the reheat steam condensate discharge. It utilizes an internal baffle in the reheating steam manifold, features which would mitigate tube binding, steam distribution to the tube bundles, flow oscillations, etc. which are expensive and difficult to alleviate.

6 Claims, 8 Drawing Sheets

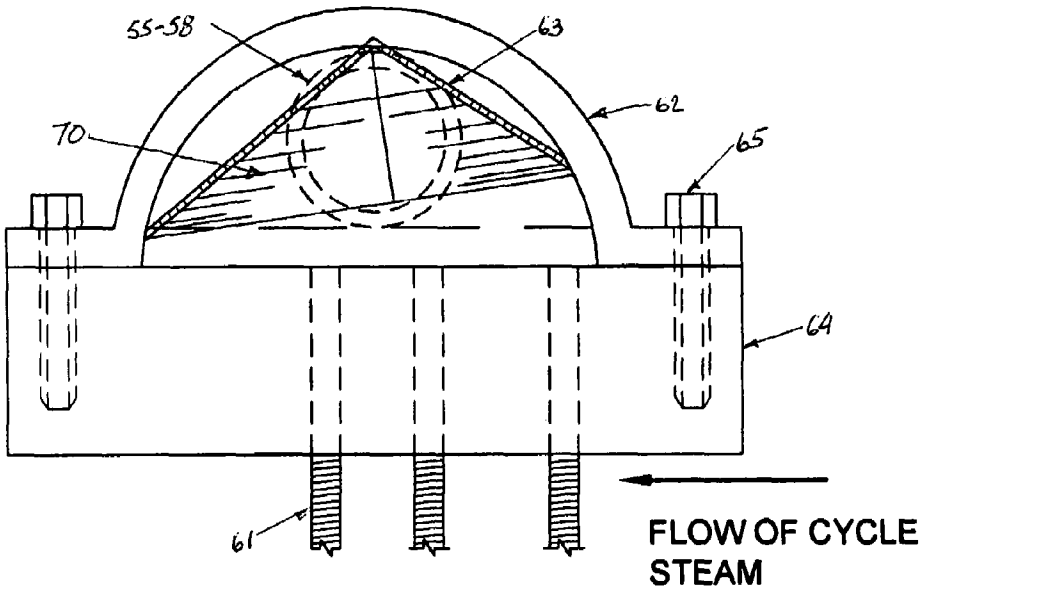
FIG. 7
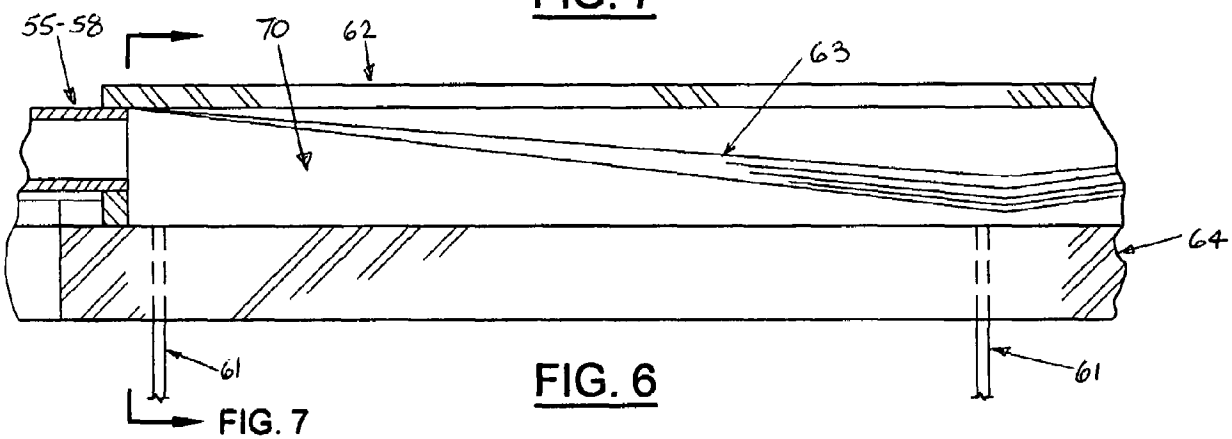
FIG. 6
FIG. 7

MOISTURE SEPARATOR AND REHEATER

BACKGROUND OF INVENTIONS

The subject of this invention is utilized in the steam cycle of a nuclear power plant. The heat exchangers in moisture separator and reheaters have, typically, employed a U-tube bundle for each stage of reheat. The aforementioned has given rise to problems of mal-distribution of the heating medium (steam) inside the tubes and instability of flow as well as binding of the tubes in the vicinity of the U-bend. These problems have been mitigated by elaborate and costly schemes affecting manufacturing cost as well as operating cost. The arrangement of various components through which cycle steam flows has been subject to uncontrolled or excessive pressure loss of a parasitic nature. The current invention effectively claims to obviate or mitigate the aforementioned problems by accommodating a means to optimize the physical arrangements of drying and reheating cycle steam.

BRIEF SUMMARY OF THE INVENTION

The configuration of the present invention incorporates a circuit for the cycle steam in relation to the moisture separator and reheaters which lends itself to an optimum configuration. Such optimum configuration would have as the objective to obtain the highest extraction of power from the cycle steam versus the manufactured and operating costs in a life cycle cost and analysis. The forgoing objective is obtained by having the most direct passage of cycle steam over the moisture separator and heat exchangers to minimize parasitic pressure losses balanced against maximum heat exchange in view of economic affects.

BRIEF SUMMARY OF THE DRAWINGS

FIG. 6 is a section illustrating one half of the pressurized manifold through which steam for the reheater tubes passes and as directed by an internal baffle. At the opposite end of the tube bundle the pressurized manifolds would be identical with the following exceptions: to drain condensate; there would be no internal baffle, and there would be one or two pipes welded into the pressurized manifold in-line to drain the condensed steam.

FIG. 7 is an end sectional view just inside the pressure boundary of the manifold which shows an internal baffle to distribute reheater steam. One of two reheater steam supply connections at either end of the pressurized manifold is indicated as well as the tube sheet and some finned tubes.

DETAILED DESCRIPTION OF THE INVENTION

Figure 1A:
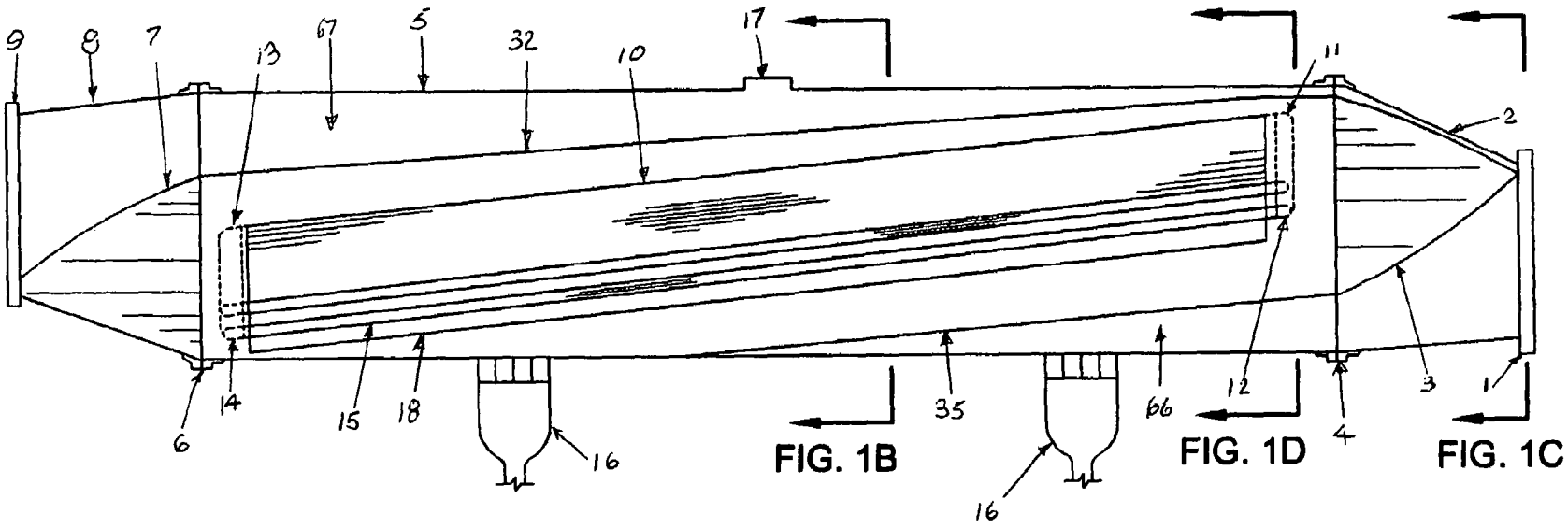
FIG. 1A is a longitudinal section of the cylindrical shell, entry and exit cones to disclose the dryer and heat exchangers (two shown) tilted at about 45°.
Figure 1B:
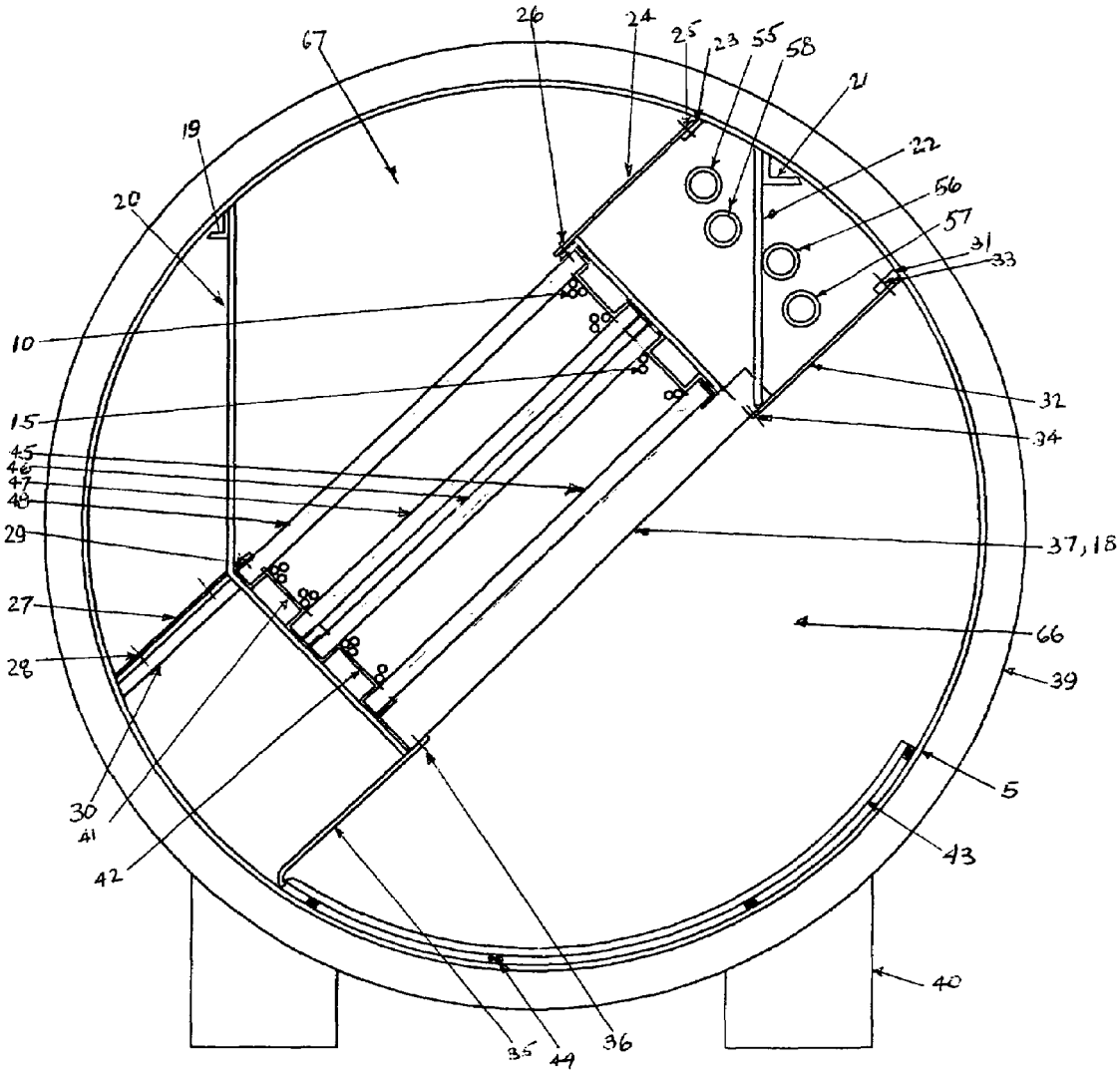
FIG. 1B is a cross section of the entire moisture separator and reheater about midway along the length of the moisture separator and reheater. Various structural hangers, baffles and supports are shown.
Figure 1C:
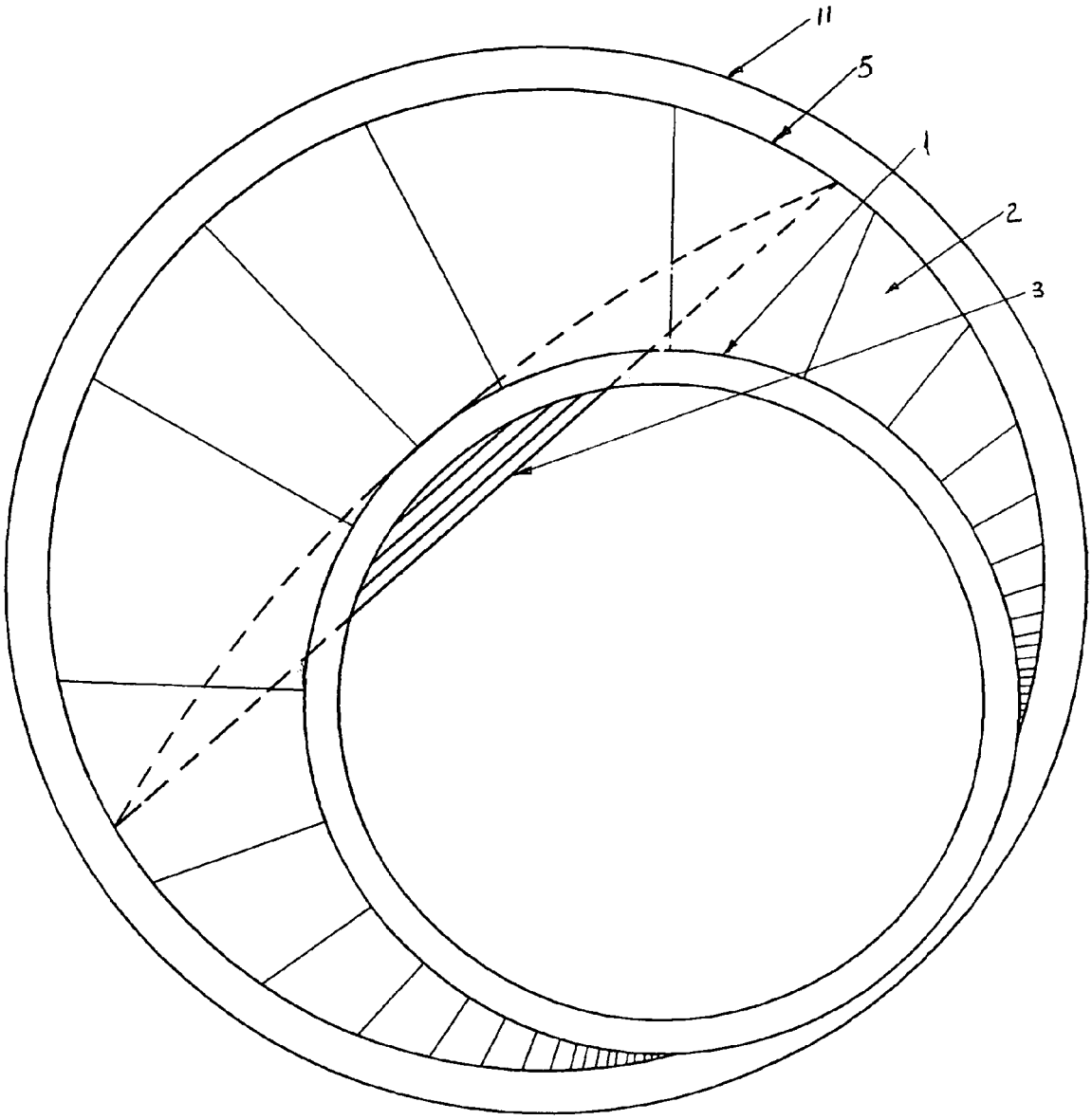
FIG. 1C is an end view, external to the moisture separator and reheater to illustrate the configuration of the offset, truncated entry cone and internal baffle.
Figure 1D:
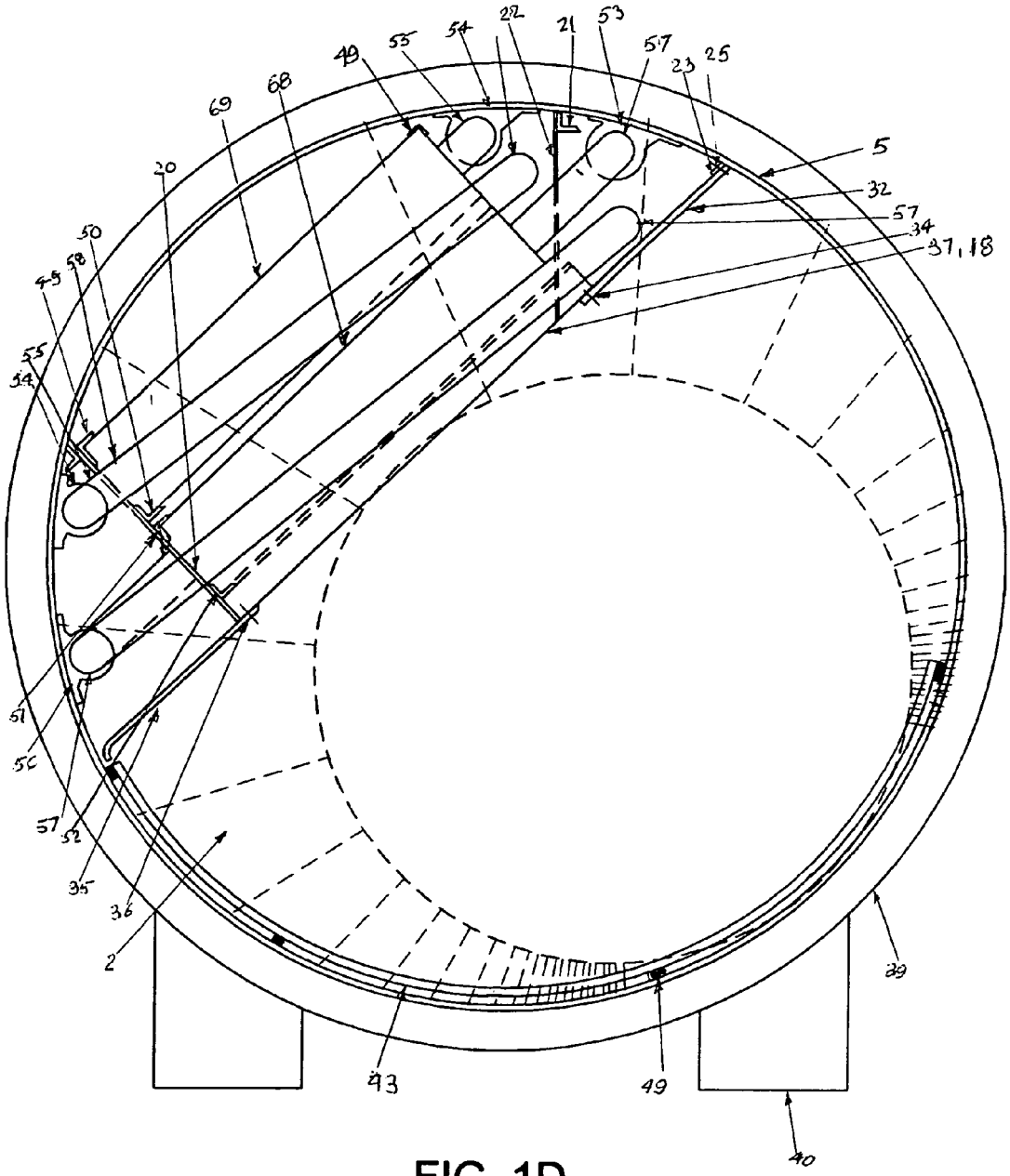
FIG. 1D is a cross section at the cycle steam entry of the moisture separator and reheater. It shows, principally, the reheater steam piping, piping guides to accommodate the expansion of the reheater assembly and as well how reheater steam piping is configured at either side of the pressurized manifold for the reheater tubes. The reheating steam manifolds are also shown.
Figure 3:
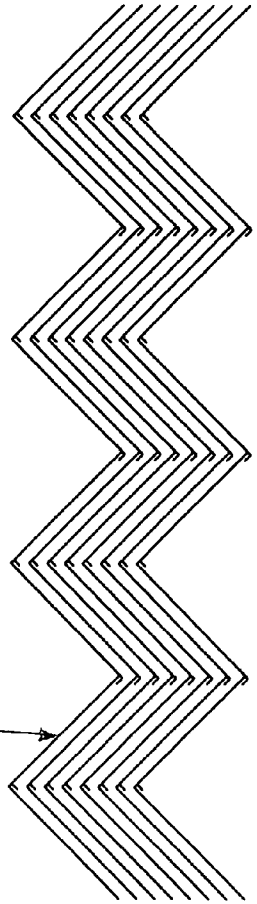
FIG. 3 illustrates a section through the corrugated plates which effect separation of moisture to dry the cycle steam.
Figure 2:
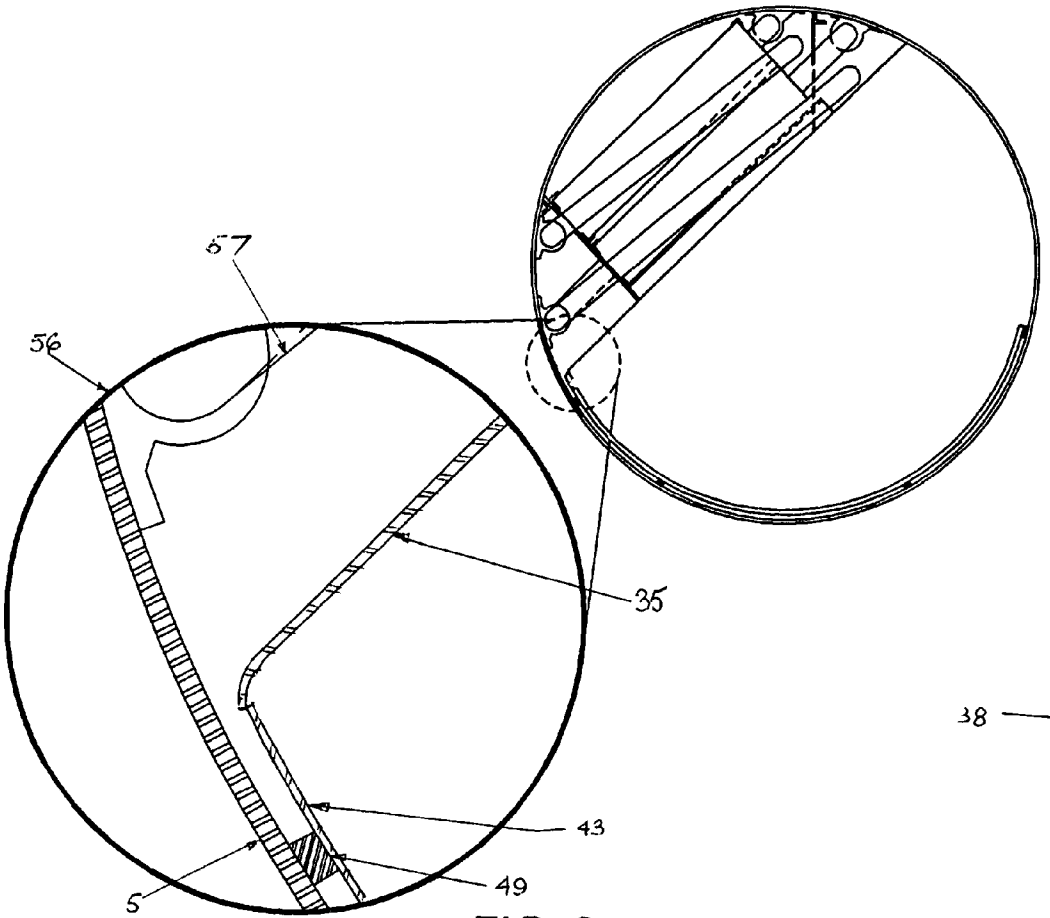
FIG. 2 is a blown-up detail of the baffle to block bypass of cycle steam as well the passage for drain of separated moisture from the dryer to an annular space just inside the outer cylindrical shell.
Figure 4:
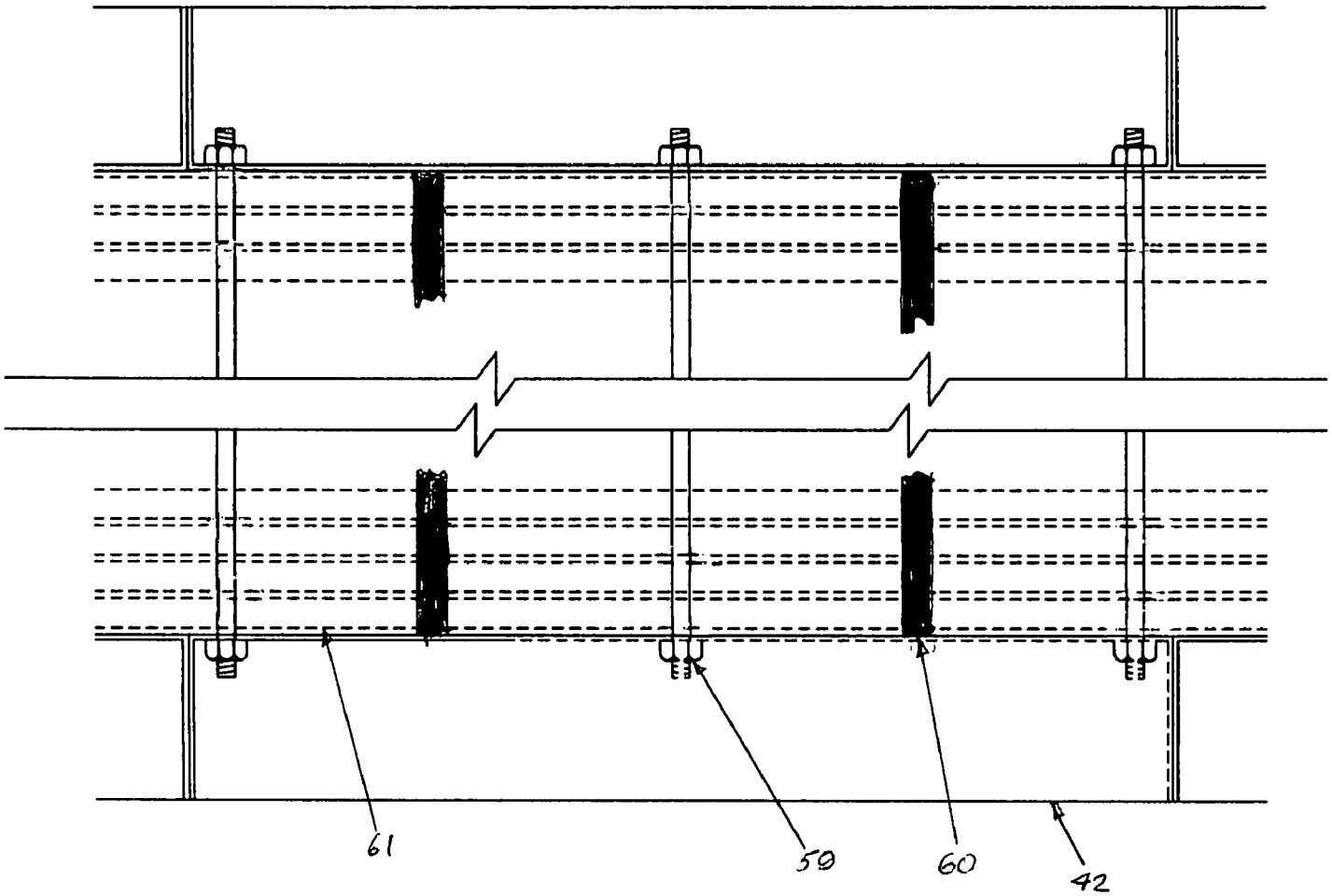
FIG. 4 is a view perpendicular to the width of a reheater. It shows long bolts to illustrate how the side plates against either side are provided to confine the flow of cycle steam through the tube bundle. The dark strips represent the spacer bars between rows of tubes and as shown in greater detail in FIG. 5.
Figure 5:
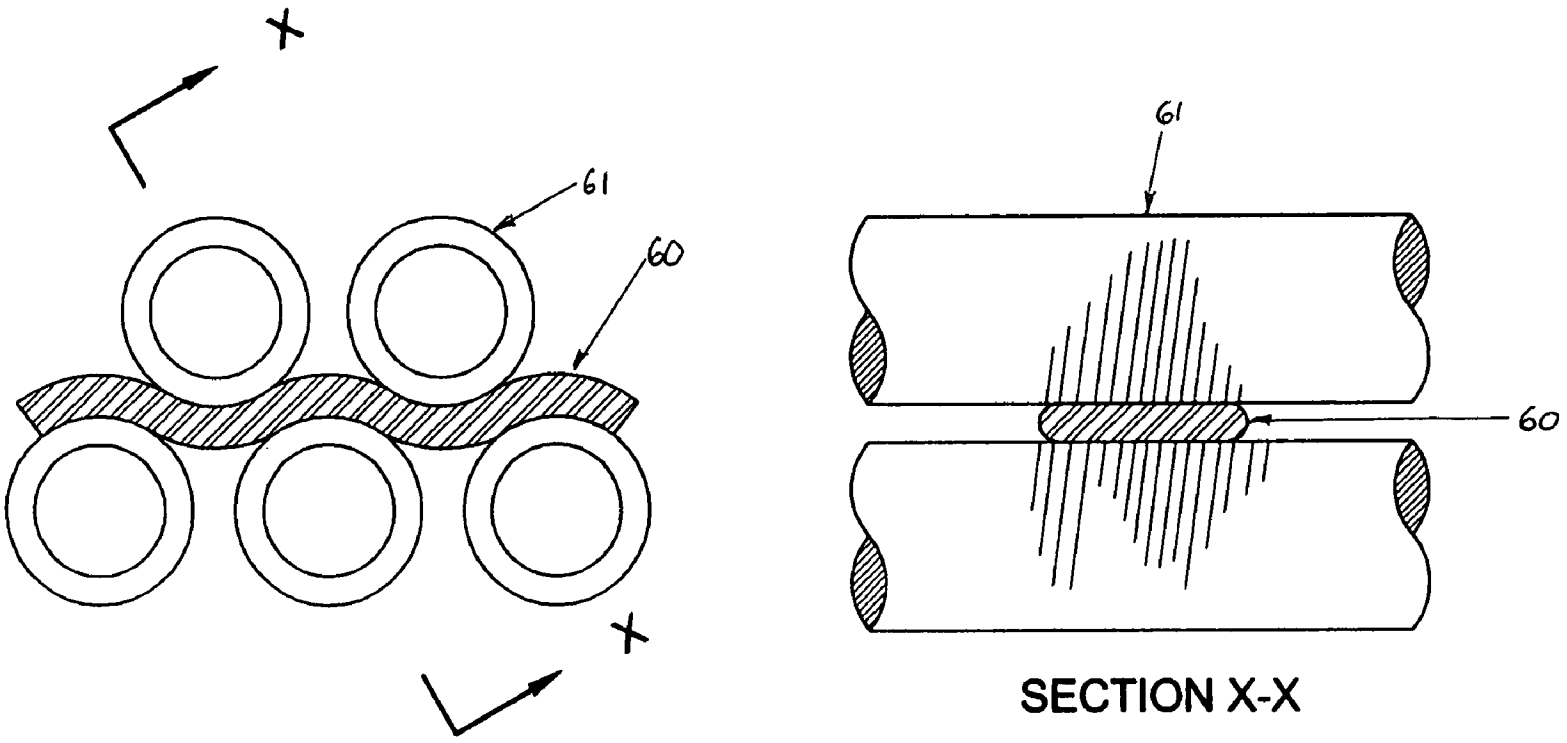
FIG. 5 shows the spacer bar placed between the horizontal rows of the reheat tube bundle and, as well, in a section x-x through a section between the tubes of two rows.

FIG. 1A shows the principal features of the moisture separator and reheater. The steam for the turbine, referred to as cycle steam, enters at the flanged connection, 1, passes into the offset truncated cone, 2, and guided by an internal baffle, 3, to the entry side of the dryer, 18, along a tapered duct, 66. The cycle steam exits the dryer and passes, successively through reheaters, of which two are shown, and exits into a tapered duct 67. The cycle steam then flows into the truncated, offset, exit cone, 8, thence to a cylindrical duct connected to flange, 9. At the top of the final table bundle of the reheaters, 13, baffle 7 serves a similar function as entry baffle, 3. The cylindrical shell, 5, provides the continuing pressure boundary for the cycle steam. Item 17 may serve as a man-way, or other use, for access to tapered duct, 67. A nozzle, similar to 17 (not shown) may be provided into shell 5 for convenient access into tapered duct 66. FIG. 1B is a cross section at a location intermediate between the entry and exit cones through which the cycle steam passes into the cylindrical shell, 5. The moisture separator, 18, and reheaters 10 and 15 are shown along with the heating steam piping 55-58. The cycle steam enters the tapered duct, 66, thence through the moisture separator, 18, and through one or more successive stages of reheaters 15 and 10, for example at progressively greater temperatures. The dried and reheated cycle steam then flows through the upper tapered duct, 67, thence exits at the opposite end of the cylindrical shell, 5. The reheater tube bundles, 15 and 10, have structural supports and spacers, 45-48, as shown in FIG. 1B. These supports are situated in the vertical plane of the tube spacers, 60, which appear in FIGS. 4 and 5. At some or all of the supports, 45-48, an underlying structural supports, 37, is, in turn, attached to hangers, 20 and 22. These hangers, 20, 22, are, in turn connected to rails 19, 21, which are welded to the top underside of the cylindrical shell, 5. Additionally, strut 30, augments hangers, 20,22, to provide a stable position of the entire assembly at moisture separator, 18, and reheaters, 10, 15. Tapered ducts, 66, for the wet cycle steam and 67 for the dried and reheated cycle steam are confined to flow through the moisture separator-reheaters, 18, 15, 10, by baffles, 24, 27, 32, 35, as shown in FIG. 1B. The cylindrical segments, 43, inside tapered duct 66 form an annular space between it and the inner surface of the cylindrical shell, 5. The spacers, 44, are of short length as to not impede the flow of condensed heating or separated moisture from cycle steam to the bottom of cylindrical shell, 5, thence to the drains, 16, shown in FIG. 1A. Successive sections of the cylindrical segments, 43, overlap each other along the length of the cylindrical shell, 5. Such overlap, not shown here, may also be observed along the upper boundary of the tapered duct in Yousoufian, U.S. Pat. No. 4,015,562, FIG. 1A. Moisture deposited on the cylindrical segments, 43, is thereby directed to the bottom of the cylindrical shell, 5, thence to the drains, 16. External to the cylindrical shell, 5, at either end are supports, 40, where the cylindrical shell, 5, is reinforced by structural rings, 39. Rails, 23, 31, along the length of cylindrical shell, 5, serve as surfaces to which baffles, 24 and 32, are fastened. Cap screws and bolts, 25, 26, 28, 29, 34, 36, are used to attach the baffles, 24, 27, 32, 35, to the stabilized structure of the moisture separator-reheater(s). FIG. 1C, as an end view of the offset conical cone at entry of the moisture separator and reheater, shows flanges 1, 11, as well as the internal baffle, 3, at entry. Said baffles, 3, adjacent to the moisture separator, 18, shall be formed to obtain a segment in the plane of entry of the moisture separator. In a similar arrangement, internal baffle, 7 is co-planer with the top most row of tubes of the reheater(s), 10. Said segment shall have a length, in the direction of the flow of cycle steam of the order of 6 inches (15 cm). The surface of the offset conical section is illustrated by 2 FIG. 1D, immediately down-stream of the offset entry cone of FIG. 1C, shows the heating steam manifolds, 68, 69, for a first stage reheater and a second stage reheater respectively. Steam to the reheater manifolds is fed from both ends. Guides, 53, 54, 56, for the piping for reheat steam, restrain translation of the piping but allow free longitudinal movement. Baffle, 35, prevents bypassing the moisture separator-reheater section and it serves as the surface over which separated moisture is diverted to the annulus created by cylindrical segments, 43 and the cylindrical shell, 5, thence to the drain (s), 16. FIG. 1D also illustrates how the dimensional proportions of the assembly of the moisture separator-reheater(s) facilitate the formation of the tapered ducts, 66, 67, previously described. FIG. 2 Shows an enlarged detail of the manner by which baffle, 35, drains into the annulus formed by the segmented baffles, 43, and cylindrical shell, 5. FIG. 3 is a cross section of some half dozen corrugated plates which comprise the moisture separator, 18. In FIG. 4 is shown a view across the width of a reheater including side plates, 42, as well as the spacer bars, 60, which are situated between rows of heat exchange tubes, 61—A detail of the foregoing spacer bar-heat exchange tubes is shown in FIG. 5. FIG. 6 shows the interior space, 70, for the flow of heating steam, essentially tapered at the entry of the tubes, 61, in the tube sheet, 64. Bolts, 65, serve to fasten the heating steam header, 62, to the tube sheet, 64, in FIG. 7. The foregoing two figures also show the relationship of the heating steam piping, 55-58, at one end of the header, 62.

What I claim as my invention is as follows:

1. An apparatus for separating moisture from and reheating steam in a cycle of a steam turbine plant comprising:

a substantially horizontal, elongated, casing having an entry end for receiving the cycle steam and an exit end opposite the entry end;

a moisture separator arranged inside the substantially horizontal elongated casing and constituting a path through which the cycle steam passes to be processed;

a lower tapered duct extending longitudinally within the casing;

overlapped cylindrical segments in the casing and at a bottom of the lower tapered duct to form annular spaces inwardly of the casing and between cylindrical segments so that all of the annular spaces provide a passage to conduct intercepted or separated moisture to at least one drain at the bottom of cylindrical casing;

a succession of reheaters of progressively higher temperature arranged contiguous to and above the moisture separator, the reheaters being defined by bundles of straight reheater tubes;

a baffle that induces a flow of reheating steam to each of the reheater tubes in proportion to an estimated thermal duty imposed at the exterior of respective rows of tubes;

the moisture separator and reheaters having a reheating steam header and a reheating condensate header near the entry and exit ends respectively of the elongated casing through which the cycle steam passes, the reheating steam header defining a highest elevation part of the moisture separator and reheaters and the condensate header defining a lowest elevation part of the moisture separator and reheaters;

the tapered duct being formed in the cavity below the moisture separators and above the final tube bundle of the reheaters;

at least one drain provided at the bottom of the elongated casing; and an arrangement of horizontal baffles, adjacent to the moisture separator and reheaters, that directs the flow of cycle steam through said moisture separator and said reheater.

2. The apparatus of claim 1 wherein the elongated casing is fitted at each end with an offset, truncated, cone with a large end and being substantially axial to the casing, and having an internal entry baffle with one edge in proximity to the large end of the cone being contiguous to the entry of the moisture separator and an exit baffle at the exit end of the casing being contiguous to an exit face of a final one of the reheaters over a segment which in each instance is about 6 inches along the flow path of the cycle steam.

3. The apparatus of claim 2, wherein corrugated strips of metal extend transverse to the reheater tubes and serve as spacers and supports between rows of reheater tubes in each of the reheater tube bundles, the strips being the placed at intervals along the tube length.

4. The apparatus of claim 3, wherein each of the corrugated strips has a dimension in the tube length direction that is approximately equal to an outside cross sectional dimension of each of the tubes.

5. The apparatus of claim 3, wherein each of the corrugated strips has a thickness in a radial direction of the straight reheater tubes that is equal to distance between adjacent reheater tubes.

6. The apparatus of claim 2, wherein the offset truncated cone at the entry end is offset toward the lower side of the elongated casing and substantially aligns with an entry end of the tapered duct, and wherein the offset truncated cone at the exit end of the elongated casing is offset toward an upper side of the elongated casing and substantially aligns with an exit end of the tapered duct.

* * * * *